United States Patent [19]

Simpson

[11] Patent Number: 4,728,375

[45] Date of Patent: Mar. 1, 1988

[54] PYROTECHNIC COMPOSITION FOR PRODUCING RADIATION-BLOCKING SCREEN

[75] Inventor: Geoffrey M. Simpson, Nottingham, United Kingdom

[73] Assignee: Haley & Weller Limited, Draycott, United Kingdom

[21] Appl. No.: 639,685

[22] Filed: Apr. 4, 1984

[30] Foreign Application Priority Data

Apr. 5, 1983 [GB] United Kingdom ..... 8309219

[51] Int. Cl.[4] ..... C06B 45/30

[52] U.S. Cl. ..... 149/5; 149/4; 149/21; 149/29; 149/72; 149/73; 102/505

[58] Field of Search ..... 149/29, 4, 5, 61, 72, 149/73, 21; 102/505

[56] References Cited

U.S. PATENT DOCUMENTS

| | | | |
|---|---|---|---|
| 2,574,466 | 11/1951 | Clay et al. | 149/29 X |
| 3,657,027 | 4/1972 | Horsey et al. | 149/29 X |
| 4,151,233 | 4/1979 | Fry | 149/29 X |
| 4,503,004 | 3/1985 | Mirabella | 149/29 X |

*Primary Examiner*—Stephen J. Lechert, Jr.
*Attorney, Agent, or Firm*—William R. Hinds

[57] ABSTRACT

A pyrotechnic composition for producing a screen for blocking the passage of infra-red radiation and of light, comprises phosphorus, preferably red amorphous phosphorus, dispersed in a binding agent, for example rubber. The composition is produced by forming the binding agent into a gel with solvent, dispersing the phosphorus into the gel, evaporating off solvent, and comminuting the resulting solid material.

6 Claims, No Drawings

PYROTECHNIC COMPOSITION FOR PRODUCING RADIATION-BLOCKING SCREEN

This invention relates to a pyrotechnic composition for producing a radiation-blocking screen, and to a method of manufacturing such a composition.

Smokes have been used to produce screens to prevent visual detection of mobile objects such as vehicles or ships. Increasing use is now made, however, of devices which can detect emissions of infra-red radiation from relatively hot parts of vehicles, such as the engines. These devices may render the vehicle vulnerable to attack by the use of infra-red sensitive sights in conjunction with conventionally-aimed weapons, or by the use of so-called heat-seeking projectiles or missiles.

The invention provides a pyrotechnic composition whose use can provide a screen capable of blocking the operation of infra-red detectors operating at wavelengths in the range of 10–14 μm, such wavelengths often being able to penetrate conventional smokes.

According to the invention, there is provided a pyrotechnic composition which, when ignited, exposively produces an infrared radiation blocking screen for an intended target, the pyrotechnic composition comprising a phosphorus and other combined components of composition, form and size as to produce an infrared radiation blocking screen operating in a first and a second mode, the first mode being provided substantially instantaneously following the explosion of the composition and comprising a cloud of high temperature gas and particles producing a broad infrared target masking the intended target, and the second mode being provided immediately following the first mode and comprising a cloud of radiation absorbent particles dispersed within the cloud to provide a large infrared absorbent area to mask the intended target for a further period.

Preferably the composition comprises a red amorphous allotropic phosphorous dispersed in a binding agent. The combustion of the red amorphous allotropic phosphorous provides the first mode, and the dispersion of the binding agent caused by the combustion of the red amorphous allotropic phosphorous causes the second mode.

Preferably the composition contains about 95% by weight of phosphorus. The composition is preferably in granular form, more preferably with the particles just passing an 8 mesh screen (i.e. having a maximum particle size of about 3.2 mm). With larger particle sizes, there is an increasing tendency for burning granules to fall to the ground, decreasing the effectiveness of the screening. Smaller particle sizes present handling difficulties.

The binding agent is suitably a rubber, such as a styrene-butadiene rubber, preferably including a carbon filler, up to 9% by weight of the rubber being a suitable proportion.

It is desirable to dust the granules with a fine powder to ensure their separation and uniform dispersion in use, and a suitable material for this is a sulphurless milled powder (SMP), being a sulphur-free gunpowder. The powder suitably forms 1 to 2% of the weight of the granules after dusting.

The invention also provides a method of manufacturing a pyrotechnic composition for producing a radiation-blocking screen, comprising forming a gel of the binding agent in a solvent, dispersing phosphorus, preferably red amorphous phosphorus, into the gel, evaporating off the solvent, and comminuting the resulting material.

It has been found that compositions in accordance with the invention can produce effective infra-red and visible light blocking for a period in excess of 30 seconds. Initially, the heat produced by the combustion of the phosphorus causes a relatively uniform emission of infra-rad radiation across the area over which the composition is distributed. This renders detection of emissions from behind the resulting cloud very difficult or impossible. When the cloud cools, an aerosol of infra-red absorbing and/or reflecting particles is left which prevents the transmission of infra-red radiation to the detector. The cloud produced is stable and is less affected by weather conditions than smokes resulting solely from the combustion of carbon-containing compounds.

The pyrotechnic composition of the invention can be used in any of the devices, such as grenades, in which known pyrotechnic compositions are used. If necessary, gunpowder or the like may be mixed with the composition to ensure wide distribution of the screen on ignition. For the production of a large screen, a plurality of charges of the composition may be dispersed and then ignited.

The following Example illustrates a pyrotechnic composition according to the invention.

EXAMPLE

A pyrotechnic composition was prepared by dissolving in dichloromethane a carbon-containing styrene-butadiene rubber (INCARB 5609, sold by International Synthetic Rubber Company Limited). Red amorphous phosphorus in powder form was dispersed into the resulting gel and the solvent was then evaporated off to leave a solid mass. The solid mass was comminuted to pass an 8 mesh screen. The resulting mixture contained, by weight, 95% of phosphorus. The rubber contained 9% by weight of carbon black. The composition granules resulting from comminution were dusted with sulphurless milled powder having a grain size similar to flour, and then packed into a container with an explosive charge dispersed through the composition. A conventional ignition charge and fuze were incorporated.

On detonation of the resulting device at a position between an infra-red source and an infra-red radiation detector, a dense cloud of smoke was produced dispersed upwardly and outwardly of the device, the cloud itself initially producing infra-red radiation which completely masked the radiation from the source, preventing its detection by the detector. As the cloud cooled, it served to block the passage of radiation from the source to the detector. The total time for which the cloud was effective in blocking detection of radiation from the source was in excess of 30 seconds. It was also observed that the cloud was impenetrable by laser beams. The cloud would therefore provide effective blocking of the operation of laser-quided projectiles and missiles, and laser range-finding devices.

I claim:

1. A pyrotechnic composition which, when ignited, explosively produces an infrared radiation blocking screen for an intended target, said pyrotechnic composition comprising a phosphorus and other combined components of composition, form and size as to constitute means for producing an infrared radiation blocking screen operating in a first and a second mode, said first mode being provided substantially instantaneously following the explosion of the composition and comprising a cloud of high temperature gas and particles producing a broad infrared target masking the intended target, said second mode being provided immediately following said first mode and comprising a cloud of radiation absorbent particles dispersed within said cloud to provide a large infrared absorbent area to mask the intended target for a further period.

2. A pyrotechnic composition as claimed in claim 1, in which the composition comprises a red amorphous allotropic phosphorous dispersed in a binding agent, the combustion of the red amorphous allotropic phosphorous providing said first mode and the dispersion of the binding agent caused by the combustion of the red amorphous allotropic phosphorous causing the second mode.

3. A pyrotechnic composition as claimed in claim 2, in which the red amorphous allotropic phosphorous and binding agent are in the form of composite particles, the particle size being relatively large to just pass through an 8-mesh screen such that the red phosphorous burns at a high temperature to provide said first mode.

4. A pyrotechnic composition, as claimed in claim 3, in which the particles are dusted with sulphurless milled gunpowder which assists, on ignition, to burn the red phosphorous at a higher temperature thereby providing a more effective broad infrared target.

5. A pyrotechnic composition, as claimed in claim 4, in which the binding agent is a rubber with carbon particles as a filler such that following ignition of said red amorphous allotropic phosphorous the rubber is also ignited and the carbon particles are dispersed in a cloud to form an infrared absorbent area which serves to screen the target for a second period of time following the first mode period of time.

6. A pyrotechnic composition which, when ignited, explosively produces an infrared radiation blocking screen capable of temporarily shielding an intended target from detection by infrared detectors operating at wave lengths in the range of 10–14 $\mu$m, said composition comprising granular material in the form of composite particles at least the majority of which are sized to just pass an 8-mesh screen and hence are of maximum particle size of about 3.2 mm, the composite particles including about 95% by weight red amorphous allotropic phosphorous dispersed in about 5% by weight of a rubber-like binding agent, the binding agent including about 9% by weight carbon as a filler, the particles being dusted with a fine ignitable powder to enhance separation and uniform dispersion, the pyrotechnic composition, when ignited and dispersed by an explosive charge, producing a cloud of high temperature gas and particles producing a broad infrared target masking the intended target, and including a cloud of radiation absorbent particles dispersed therein to provide a large infrared absorbent area to mask the intended target for a further period after cooling of the gas and particles and termination of the infrared radiation from the high temperature gas and particles.

* * * * *